US007303611B2

(12) United States Patent
Bae et al.

(10) Patent No.: US 7,303,611 B2
(45) Date of Patent: Dec. 4, 2007

(54) HUMIDITY ADJUSTING APPARATUS USING DESICCANT

(75) Inventors: Seong Won Bae, Seoul (KR); In Hwa Jung, Seoul (KR); Deok Huh, Boocheon-si (KR); Sim Won Chin, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 411 days.

(21) Appl. No.: 11/008,291

(22) Filed: Dec. 10, 2004

(65) Prior Publication Data

US 2005/0257688 A1 Nov. 24, 2005

(30) Foreign Application Priority Data

May 21, 2004 (KR) ..... 10-2004-0036423

(51) Int. Cl.
*B01D 53/02* (2006.01)

(52) U.S. Cl. ..... 96/121; 96/123; 96/130; 96/143

(58) Field of Classification Search ..... 95/107, 95/117, 121, 123, 126; 96/121, 130, 143, 96/123; 62/271
See application file for complete search history.

(56) References Cited

U.S. PATENT DOCUMENTS

| | | | |
|---|---|---|---|
| 1,548,158 | A | 8/1925 | Murray |
| 2,540,492 | A | 2/1951 | Schmuckler |
| 4,754,806 | A | 7/1988 | Astle, Jr. |
| 5,148,374 | A | 9/1992 | Coellner |
| 5,931,015 | A | 8/1999 | Maeda |

FOREIGN PATENT DOCUMENTS

| | | |
|---|---|---|
| EP | 0260907 | 3/1988 |
| JP | 59-100395 | 6/1984 |
| JP | 64-085112 | 3/1989 |
| JP | 2-197733 | 8/1990 |

OTHER PUBLICATIONS

U.S. Appl. No. 10/668,155, filed Sep. 24, 2003.
U.S. Appl. No. 10/668,162, filed Sep. 24, 2003.
U.S. Appl. No. 10/914,106, filed Aug. 10, 2004.
U.S. Appl. No. 10/943,134, filed Sep. 17, 2004.
English Language Abstract of JP 2-197733, Aug. 1990.
English Language Abstract of JP 1-085112, Mar. 1989.
English Language Abstract of JP 59-100395, Jun. 1984.

*Primary Examiner*—Robert A. Hopkins
(74) *Attorney, Agent, or Firm*—Greenblum & Bernstein, P.L.C.

(57) ABSTRACT

A humidity adjusting apparatus includes at least one desiccant linearly reciprocated between a dehumidifying unit and a drying unit, and a motor for driving the desiccant to be moved, thereby improving dehumidifying and humidifying efficiency.

19 Claims, 6 Drawing Sheets

HUMIDITY ADJUSTING APPARATUS USING DESICCANT

BACKGROUND OF THE INVENTION

1. Field of the Invention

The present invention relates to a humidity adjusting apparatus using a desiccant, which can easily adjust a dehumidifying volume, and more particularly, to a humidity adjusting apparatus with an improved structure that can increase an amount of a desiccant received in a limited space, resultantly increasing or decreasing humidifying and/or dehumidifying volumes.

2. Description of the Related Art

A general humidity adjusting apparatus uses a desiccant to increase or decrease the humidity in a room or other enclosure. The desiccant is a substance that has a high affinity for water and is used as moisture absorbent. The desiccant absorbs moisture from ambient air in a common state, thereby making the air dry. The moisture is then evaporated by means of the ambient conditions such as heating, and then the moisture absorbent returns to its original state. As the desiccant repeats to absorb moisture and be dried, the moisture is moved from one spot to another spot, thereby controlling humidity in a system that is a desired indoor space. The desiccant is designed to absorb moisture in air when surface vapor pressure is less than partial pressure of ambient air and to discharge moisture when the surface vapor pressure is less than the partial pressure of the ambient air.

U.S. Pat. No. 5,148,374 discloses such a humidity adjusting apparatus using a desiccant. The humidity adjusting apparatus disclosed in the patent has a desiccant wheel in which the circular desiccant is received. The desiccant wheel is designed to periodically rotate in the wheel so as to absorb and discharge moisture from and to air being introduced.

However, the desiccant wheel receiving a desiccant has a shape of a circular flat plate that two-dimensionally rotates. The humidity adjusting apparatus is operated by absorbing moisture at one side while rotating, and removing moisture at the other side with applying heat. Thus, in order to increase a humidifying or dehumidifying amount for use in a high humid region, the size of the desiccant wheel should be increased. However, if the size of the desiccant wheel is increased, the whole size of the humidity adjusting apparatus itself should be increased resultantly.

In addition, if the humidity adjusting apparatus is enlarged, the manufacture cost for the apparatus is increased and the convenience for using the apparatus becomes worse.

SUMMARY OF THE INVENTION

Accordingly, the present invention is directed to a desiccant humidifier with an improved structure that increases a volume of a desiccant received in a limit space, resultantly increasing a humidifying and/or dehumidifying amount.

To achieve the object, there is provided a humidity adjusting apparatus including: a dehumidifying unit for absorbing moisture contained in air; a drying unit for emitting moisture to air so that the air is changed into a humid air; a barrier wall for partitioning the dehumidifying unit and the drying unit; at least one plate-shaped desiccant translated across the barrier wall to the dehumidifying unit or the drying unit; and a motor for giving a driving force to move the desiccant.

In another aspect of the invention, there is also provided a humidity adjusting apparatus including a barrier wall for partitioning an inner space of the apparatus into a dehumidifying unit and a drying unit; a plurality of desiccants linearly reciprocated across the barrier wall; and a motor for giving a driving force to move the desiccants.

In still another aspect of the invention, there is also provided a humidity adjusting apparatus including a plurality of desiccants linear reciprocated between a drying unit and a dehumidifying unit and moving together; and a motor for giving a driving force to the desiccants.

According to the present invention, the humidity adjusting apparatus may be small-sized. In addition, the humidity adjusting apparatus of the present invention may give increased humidifying and dehumidifying volumes with a small size rather than the conventional one.

Furthermore, the humidity adjusting apparatus of the present invention may be more efficiently used due to the increased humidifying volume.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
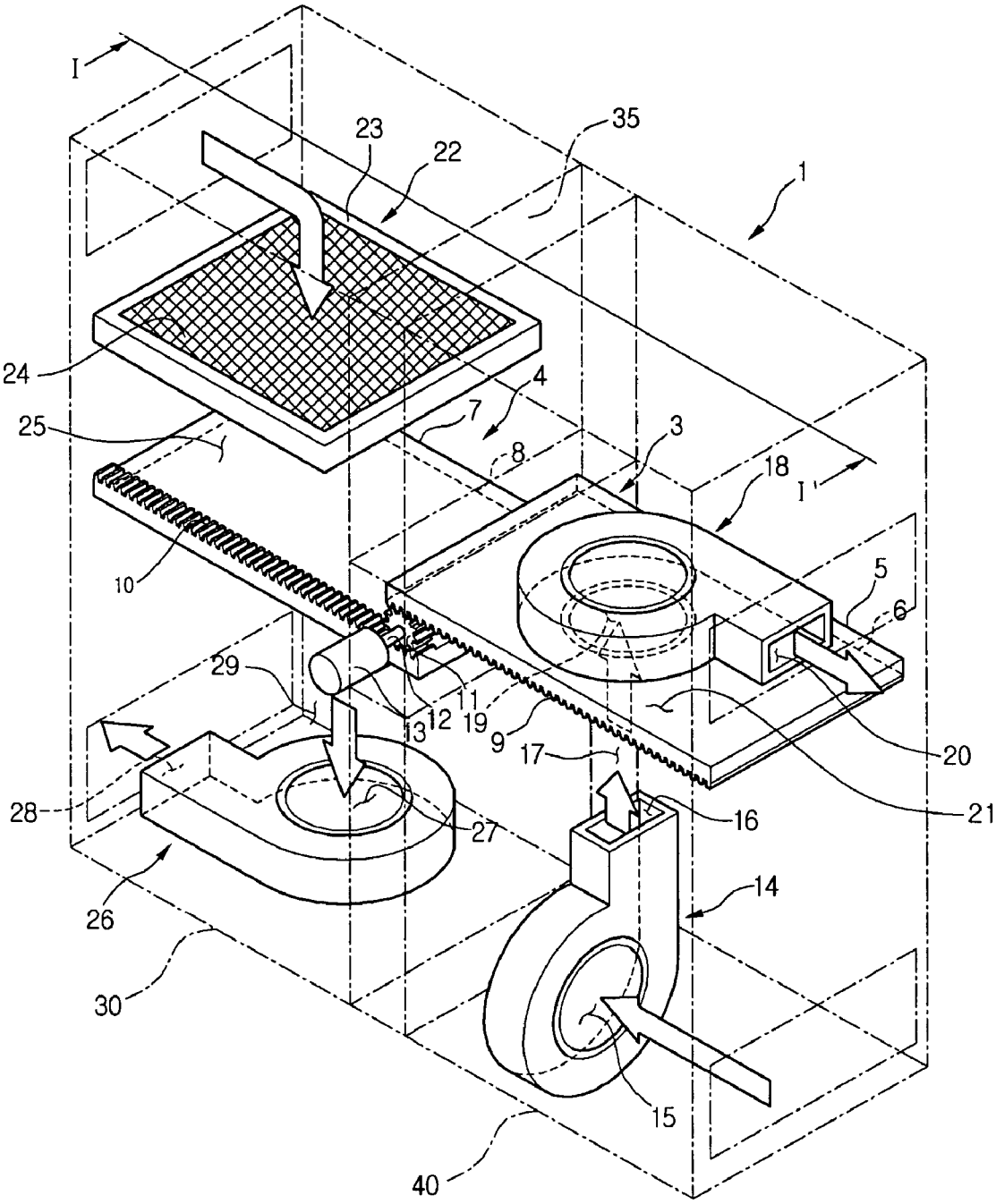
FIG. 1 is a perspective view of a humidity adjusting apparatus according to the present invention.

FIG. 1 is a perspective view showing a humidity adjusting apparatus according to the present invention.

Referring to FIG. 1, the humidity adjusting apparatus 1 includes a dehumidifying unit 40 for removing moisture from air by keeping the moisture in a desiccant, a drying unit 30 for drying air by evaporating the moisture kept in the desiccant and then emitting it in the air, and a barrier wall 35 for partitioning the dehumidifying unit 40 and the drying unit 30. A desiccant unit is formed to move between the dehumidifying unit 40 and the drying unit 30 so that the moisture absorbed in the dehumidifying unit 40 is evaporated in the drying unit 30. The desiccant unit is translated with coming and going between the dehumidifying unit 40 and the drying unit 30.

The desiccant unit includes a first desiccant 3 positioned in an upper position and a second desiccant 4 positioned below the first desiccant 3. The first desiccant 3 has a plate shape with a front surface 5 and a rear surface 6, while the second desiccant 4 has a plate shape with a front surface 7 and a rear surface 8. The desiccant preferably has a rectangular shape to improve moisture absorbing and emitting efficiency since it is linearly moved. The first and second desiccants 3 and 4 carry moisture with coming and going across the barrier wall 35 between the drying unit 30 and the dehumidifying unit 40. Now, mechanism for moving the desiccants 3 and 4 is described below.

A first rack 9 is formed at one side of the bottom 6 of the first desiccant 3, and a second rack 10 is formed at one side of the upper surface 7 of the second desiccant 4, respectively. Of course, the first and second racks 9 and 10 are faced with each other to be moved together. A pinion 11 is formed between the first and second racks 9 and 10 so that the first and second racks 9 and 10 are engaged with it. A motor 13 is also provided as a driving means for rotating the pinion 11. By using this configuration, if the motor 13 gives a rotational force, the pinion 11 is rotated so that the racks 9 and 10 engaged with the pinion 11 itself are translated in a lateral direction, thereby making the desiccant moved. Of course, it is also possible that the desiccants 3 and 4 are moved and selectively put in the drying unit 30 and the dehumidifying unit 40 in order to move humidity.

Here, in case the configuration using the racks 9 and 10 and the pinion 11 is applied to the humidity adjusting apparatus 1 using desiccant, the motor 13 should give repeated clockwise and counterclockwise rotations at regular intervals. Thus, the motor 13 preferably uses a step motor that gives clockwise/counterclockwise rotations with relatively more accurate angle and velocity.

In this embodiment, there is used only one set of the first desiccant 3, the second desiccant 4 and/or the motor 13. However, not limited to that case, the humidity adjusting apparatus of the present invention may have two or more sets only if it may guide movement of the desiccants 3 and 4 accurately. In addition, the positions of the sets may be variously selected. That is to say, there may be included several sets of the first desiccant 3, the second desiccant 4 and the motor 13 according to the required humidifying and dehumidifying amounts and the output of a blowing fan.

The structure having the racks 9 and 10 and the pinion 11 acts as a means for converting a rotation force of the motor 13 into a linear reciprocating movement. Thus, the structure having the racks 9 and 10 and the pinion 11 may be replaced with a cam structure that is also used for converting a rotation movement of a driving means into a linear reciprocating movement.

As known from the aforementioned configuration, in the humidity adjusting apparatus 1 of the present invention, the desiccant is linearly reciprocated, not rotated. Thus, it may accomplish the humidifying and dehumidifying function with a space smaller than required for rotation of the desiccant in the conventional humidity adjusting apparatus. Thus, various means for linear reciprocation of the desiccant, not rotation thereof, may be proposed, and they also belong to the scope of the invention.

Meanwhile, to describe the configuration of the dehumidifying unit 40 in detail, the dehumidifying unit 40 includes an intake fan 14 for introducing air into the dehumidifying unit 40, and an exhaust fan 18 for exhausting the air introduced by the intake fan 14 and then exchanging moisture with the desiccant. In more detail, the intake fan 14 and the exhaust fan 18 respectively have intake holes 15 and 19 for introducing air and exhaust holes 16 and 20 for exhausting air. In the figure, the space formed between the intake fan 14 and the desiccant 3 is an intake channel 17 for a humid air to flow, while the space formed between the desiccant 3 and the exhaust fan 18 is a drying channel 21 for a dry air to flow. It might be easily guessed that much moisture is kept in the air passing through the intake channel 17, and moisture is removed from the air passing through the drying channel 21 so that relatively dry air flows therein.

To describe the drying unit 30 in detail, the drying unit 30 includes an exhaust fan 26 for introducing and exhausting air with forming a channel separate from the channels formed by the intake fan 14 and the exhaust fan 18 of the dehumidifying unit 40, and a heater 22 acting as a heating means for heating the air introduced in the desiccants 3 and 4 into a high temperature air. In more detail, the exhaust fan 26 has an intake hole 27 for introducing air and an exhaust hole 28 for exhausting air. In addition, the heater 22 includes a heater case 23 and a grill 24 to form an appearance of the heater 22. The space formed between the heater 22 and the desiccant 2 s a high temperature channel 25 for the air heated by the heater 22 to flow, while the space formed between the desiccants 3 and 4 and the exhaust fan 26 is a humid channel 29 for the air with high temperature and high humidity to flow.

Meanwhile, the exhaust fan 26 plays roles of introducing and exhausting air at the same time inside the drying unit 30. However, it is also possible to form another intake fan for better air introduction into the drying unit 30.

Figure 2:
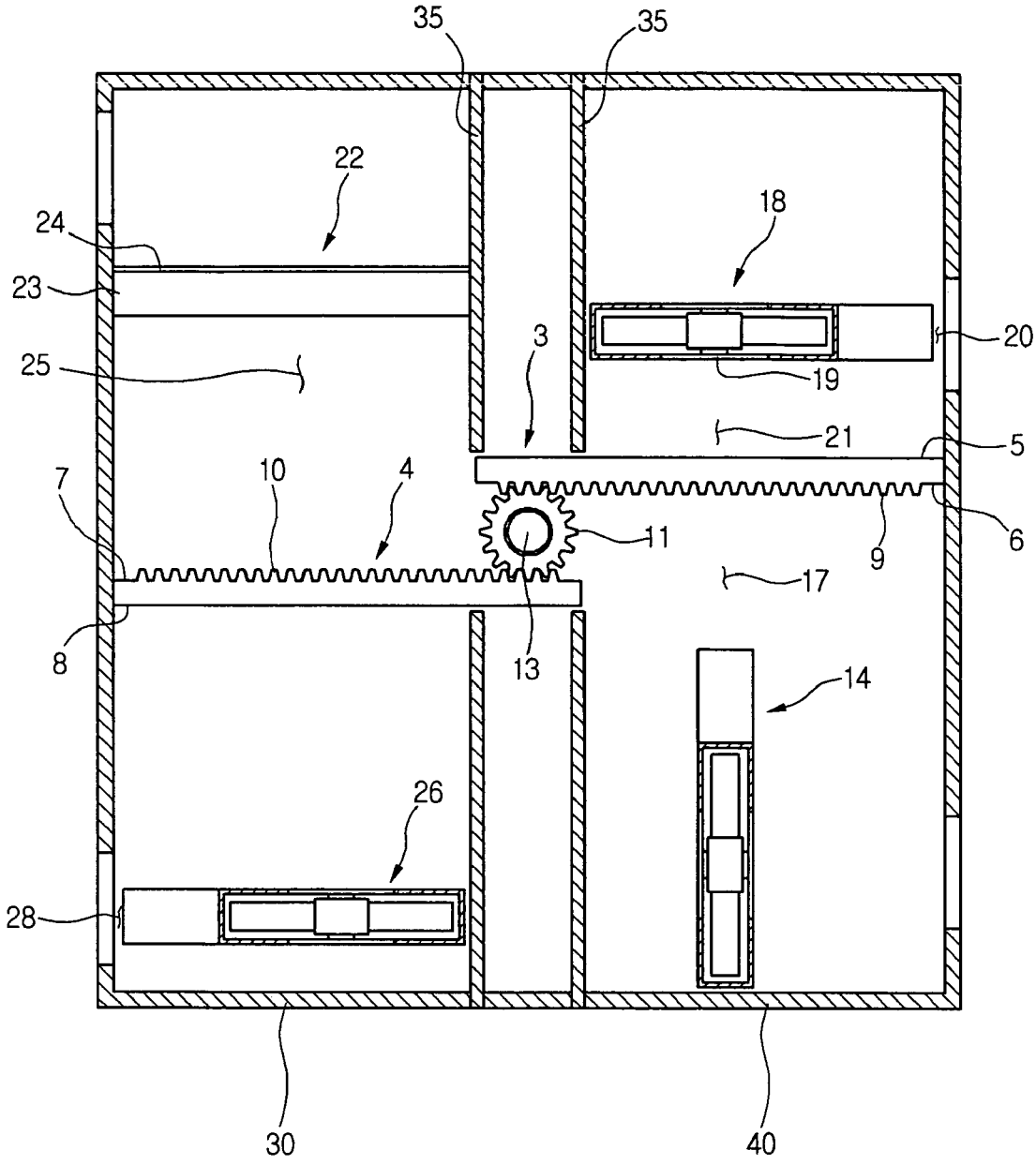
FIG. 2 is a sectional view taken along I-I' line of FIG. 1.

Hereinafter, operation of the humidity adjusting apparatus using desiccants according to the present invention will be described in order with reference to the accompanying drawings. FIG. 2 is a sectional view taken along I-I' line of FIG. 1.

Referring to FIG. 2, the barrier wall 35 is formed between the drying unit 30 and the dehumidifying unit 40. In the dehumidifying unit 40, the moisture kept in the introduced air is absorbed in the desiccants 3 and 4 and then removed, while, in the drying unit 30, the moisture kept in the desiccants 3 and 4 is removed into air. It may be easily guessed that moisture is removed in the drying unit 30 by means of the heater 22.

The first and second desiccants 3 and 4 are moved laterally by means of the pinion 11. If any of the desiccants 3 and 4 is moved to the dehumidifying unit 40, it holds moisture, while, if the desiccant with moisture is moved to the drying unit 30, the moisture kept in the desiccant is emitted to air by means of a high temperature air and then dried. As this procedure is repeated, moisture included in the air passing through the dehumidifying unit 40 may be exhausted to the drying unit 30.

If the dehumidifying unit is connected indoors, the humidity adjusting apparatus of the present invention functions as a dehumidifier, while, if the drying unit is connected indoors, the apparatus functions as a drier. However, all devices functioning as a passage of moisture as mentioned above are commonly called 'dehumidifier'.

Hereinafter, operation of the humidity adjusting apparatus according to the present invention will be described in order. FIGS. 3 to 6 are sectional views showing operation procedures of the humidity adjusting apparatus according to the present invention. Now, operation of the humidity adjusting apparatus according to the present invention is described with reference to FIGS. 3 to 6.

Figure 3:
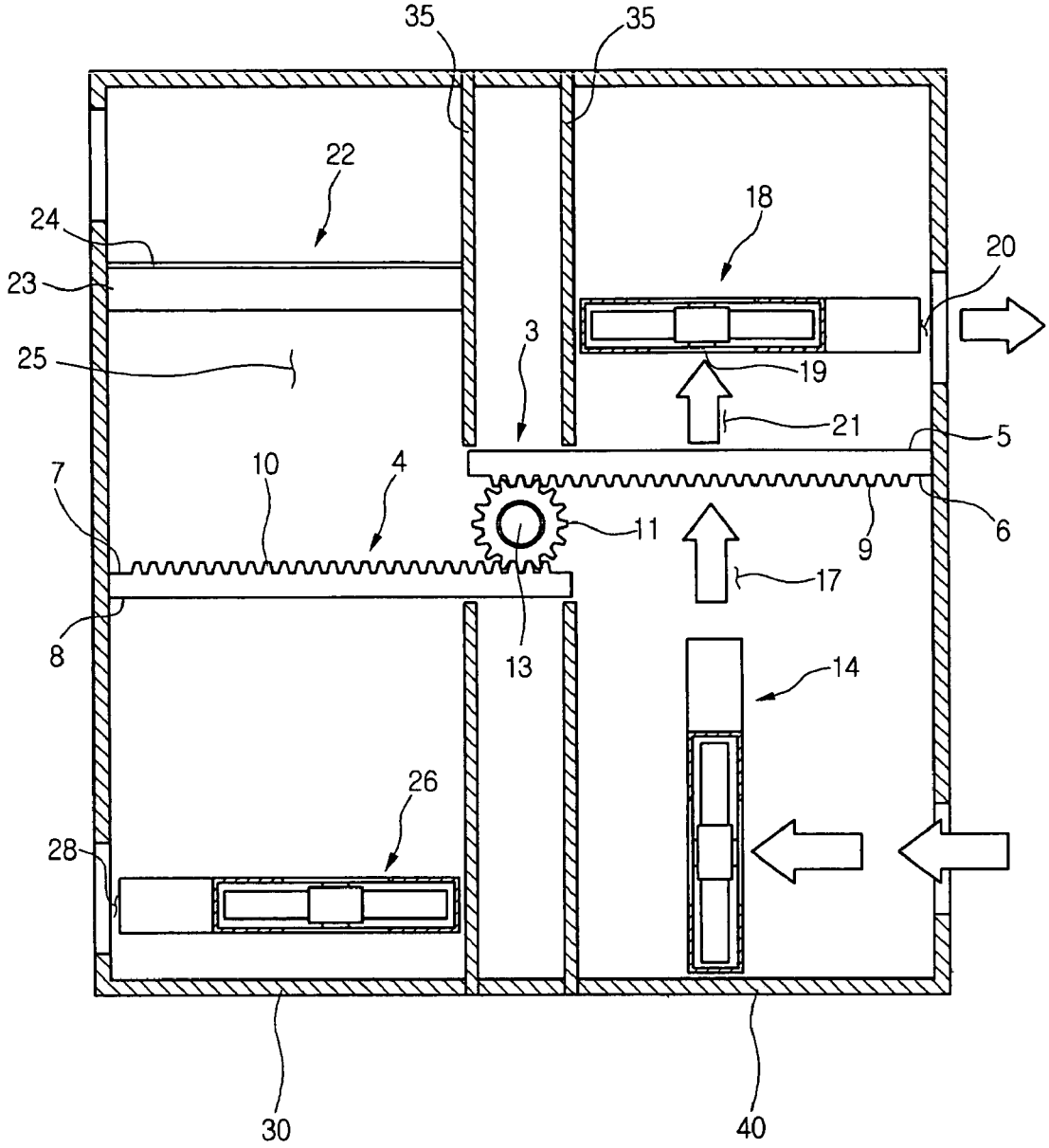
FIG. 3 is a sectional view for illustrating that the air containing moisture is introduced into the humidity adjusting apparatus after the humidity adjusting apparatus using desiccant according to the present invention starts operation.

FIG. 3 shows that the air containing moisture is introduced into the humidity adjusting apparatus after the apparatus starts operating.

Referring to FIG. 3, the first desiccant 3 is positioned in the dehumidifying unit 40 between the intake fan 14 and the exhaust fan 18, and the second desiccant 4 is positioned in the drying unit 30 between the exhaust fan 26 and the heater 22. In this state, if a user turns on the humidity adjusting apparatus, the intake fan 14 and the exhaust fan 18 are operated to form an air channel in the dehumidifying unit 40. In detail, an external air passes through the intake fan 14 and is then introduced into the dehumidifying unit 40. In addition, the introduced air passes through the first desiccant 3 via the intake channel 17. During this process, moisture contained in the air is absorbed to the first desiccant 3. At this time, the first desiccant 3 is originally dry. Since the first desiccant 3 is dry, the moisture contained in the introduced air is absorbed to the first desiccant 3 while passing through it. Thus, the first desiccant 3 becomes humid with keeping moisture therein, and the air loses moisture and is changed into a dry air.

The dry air without moisture passes through the dry channel 21, and is then exhausted out of the humidity adjusting apparatus 1 through the exhaust fan 18. It may be easily guessed that the air passing through the dehumidifying unit 40 is in a dry state. It is also guessed that, in case the dehumidifying unit 40 is connected indoors, the humidity adjusting apparatus removes moisture in the room.

Meanwhile, it may be easily guessed that the second desiccant 4 is put in the drying unit 30 and operated without moisture in the case of FIG. 3.

Figure 4:
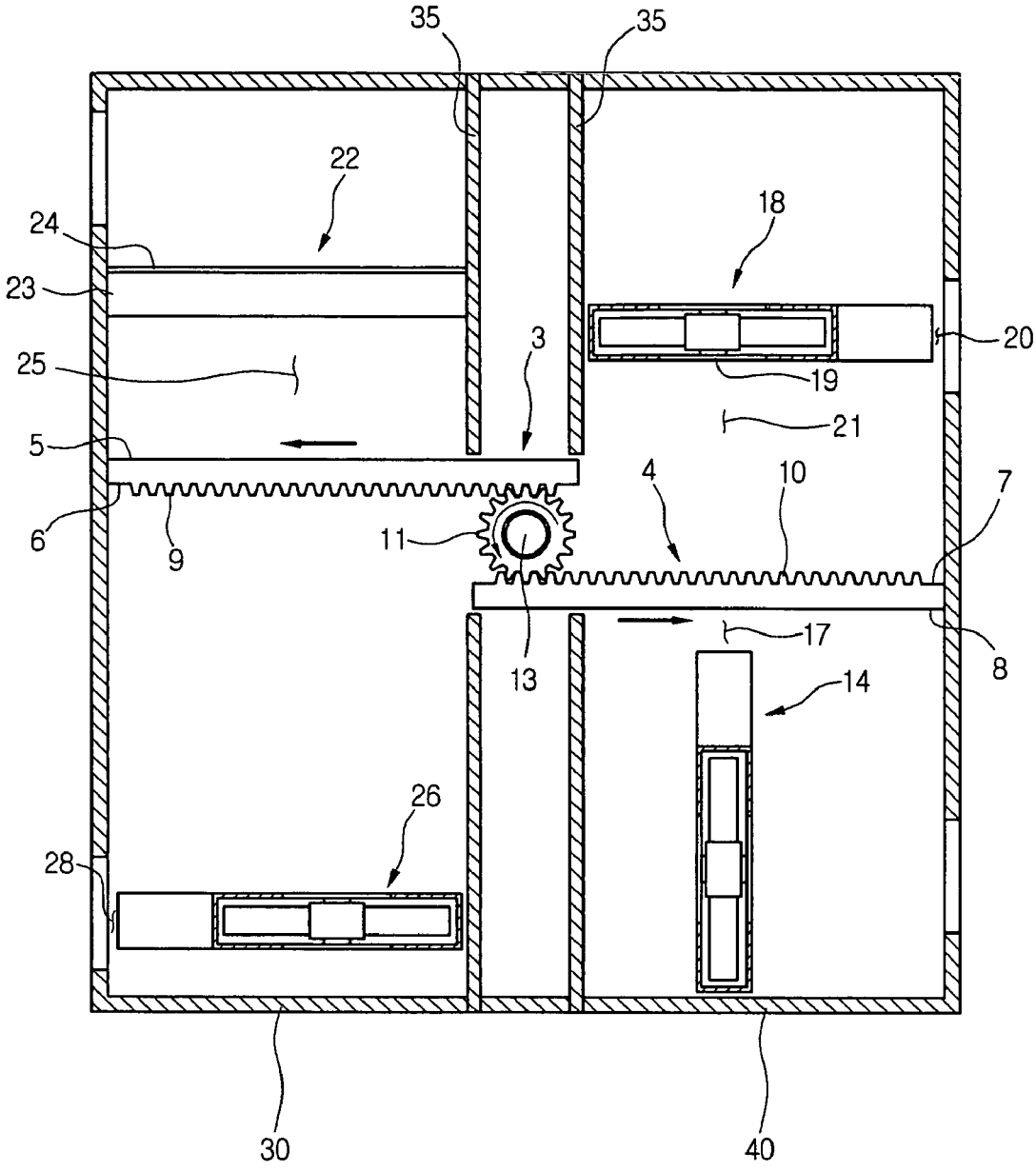
FIG. 4 is a sectional view for illustrating that positions of first and second desiccants are shifted in the humidity adjusting apparatus using desiccant according to the present invention.

FIG. 4 is for illustrating that the first and second desiccants shift their positions in the humidity adjusting apparatus according to the present invention.

Referring to FIG. 4, when the first desiccant 3 keeps moisture to a certain level and cannot take moisture any more, the first desiccant 3 shifts its position with the second desiccant 4 by means of a rotational force of the motor 13. In detail, If the motor 13 gives a counterclockwise rotational force, the pinion 11 is also rotated in a counterclockwise direction with giving its force to the racks 9 and 10 engaged with the pinion 11. Then, the first rack 9 is moved left on the figure, and the second rack 10 is moved right. That is to say, the racks 9 and 10 are moved in opposite directions. As a result, the first and second desiccants 3 and 4 connected to the first and second racks 9 and 10 respectively are also linearly moved in opposite directions.

Meanwhile, it may be seen that the movement direction the desiccants 3 and 4 and the length direction of the desiccants 3 and 4 are orthogonal to the flowing direction of air passing through the desiccants 3 and 4. This makes a larger area of the desiccants be contacted with air.

Figure 5:
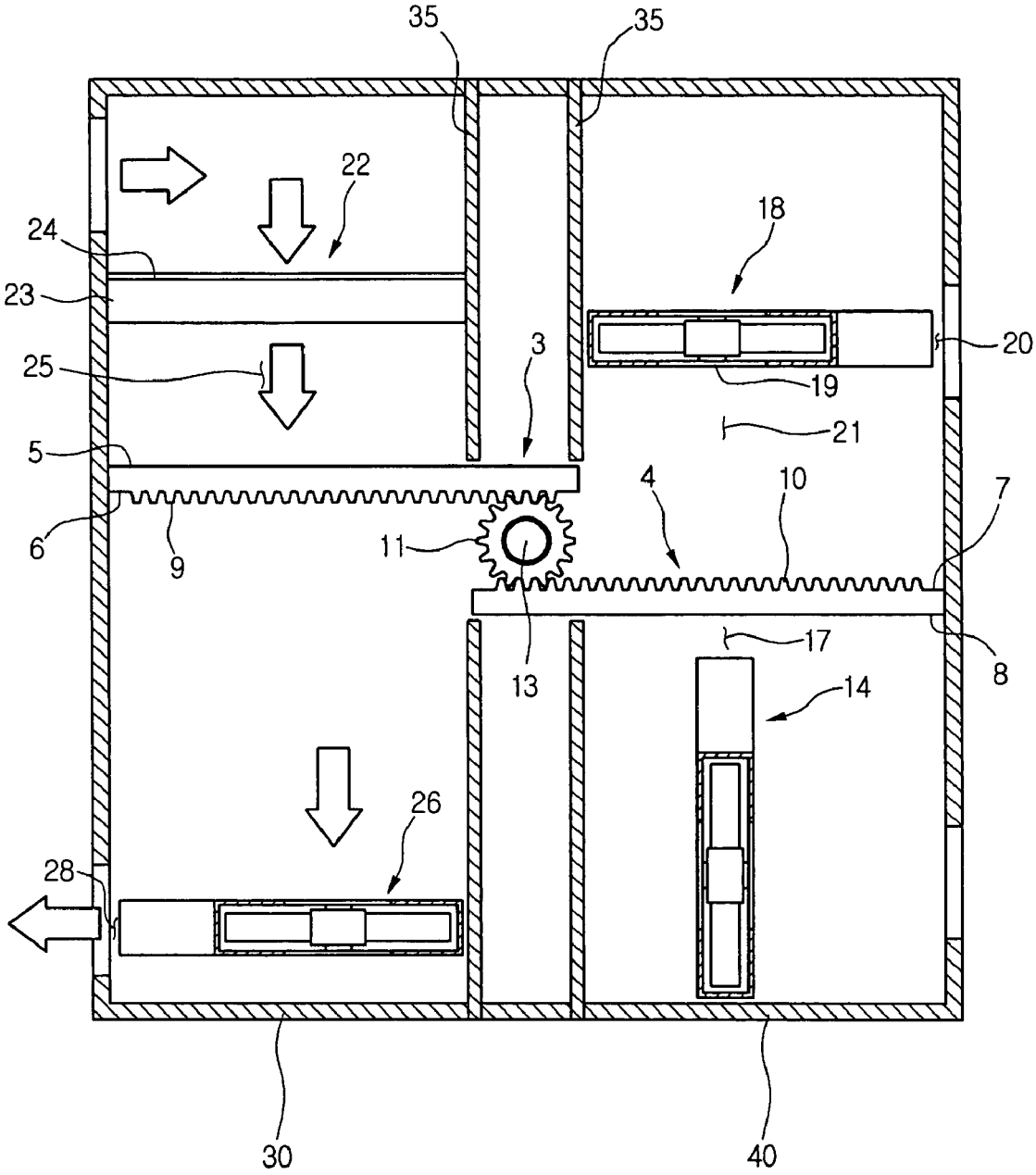
FIG. 5 is a sectional view for illustrating that moisture is removed in the humidity adjusting apparatus using desiccant according to the present invention.

FIG. 5 is for illustrating the process of removing moisture in the humidity adjusting apparatus according to the present invention.

Referring to FIG. 5, due to the introduction force generated by the exhaust fan 26 put in the drying unit 30, an external air is introduced and converted into a high temperature air with passing through the heater 22, and then the air passes through the first desiccant 3. During this procedure, moisture absorbed in the first desiccant 3 is evaporated and absorbed in the air by means of the heat transferred by the high temperature air. Thus, the air is changed into a humid air. The humid air with moisture is exhausted out of the humidity adjusting apparatus through the exhaust fan 26.

In case the drying unit 30 is connected indoors, the humidity adjusting apparatus may function as a dryer. In addition, since the second desiccant 4 is put in the dehumidifying unit 40 when the first desiccant 3 is put in the drying unit 30, it may be easily guessed that the second desiccant 4 absorbs moisture.

Figure 6:
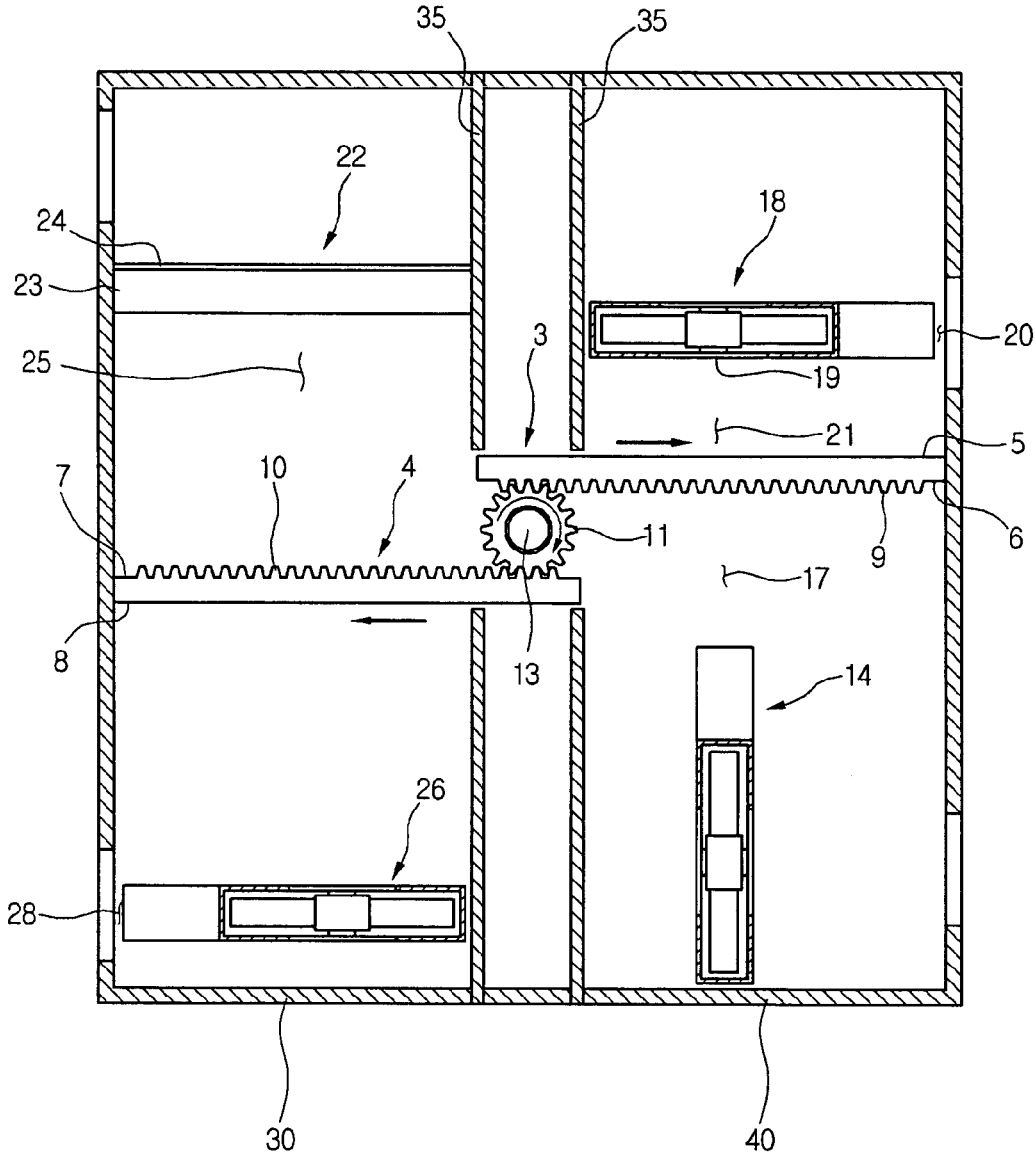
FIG. 6 is a sectional view for illustrating that positions of first and second desiccants are shifted in the humidity adjusting apparatus using desiccant according to the present invention.

FIG. 6 is for illustrating that the first and second desiccants shift their positions in the humidity adjusting apparatus according to the present invention. In FIG. 6, the desiccants are moved reverse to that of FIG. 4.

That is to say, the motor 13, the pinion 11 and the racks 9 and 10 are moved in opposite directions to the case of FIG. 4, thereby shifting the positions of the first and second desiccants. After those movements, the first desiccant 3 will collect moisture as suggested in FIG. 3.

The procedures explained in FIGS. 3 to 6 will be repeated, and the repeated operations help moisture to be moved from one spot to another spot. Though the behavior of moisture was explained above on the basis of the first desiccant 3, it may be understood that the same behavior may be applied to the second desiccant 4. Furthermore, it may be easily guessed that the second desiccant 4 removes moisture when the first desiccant 1 collects moisture, the first desiccant 3 removes moisture when the second desiccant 4 collects moisture, and the second desiccant 4 is moving when the first desiccant 3 is moving.

If the motor 13 repeats clockwise and counterclockwise rotations, the first and second desiccants 3 and 4 alternately absorb moisture or exhaust the absorbed moisture, respectively. Thus, the humidity adjusting apparatus of the present invention may conduct the humidifying function and/or the dehumidifying function continuously. The motor 13 is preferably a step motor so that the motor 13 may give accurate periodical clockwise and counterclockwise rotations.

Since the first and second desiccants 3 and 4 are linearly reciprocated, the space required for regenerating the desiccant may be remarkably reduced rather than the conventional one. Thus, the humidity adjusting apparatus may be made smaller than a conventional one with ensuring increased humidifying and dehumidifying amounts.

Meanwhile, the humidity adjusting apparatus of the present invention may function as a dehumidifier and a humidifier respectively according to the connection state of the humidifying unit and the drying unit. In addition, the moisture is moved by means of linear reciprocation of the plate-shaped desiccant in the present invention, and any operation mechanism other than that the rack-pinion mechanism may be applied if it satisfies the above operation condition.

In addition, though two plate-shaped desiccants are spaced apart in this embodiment, the spirit of the present invention may be easily realized even when more than two desiccants are installed at intervals.

Moreover, the interval that the desiccants shift their positions may be set on the basis of the time required for absorbing moisture or evaporating moisture. In addition, it is also possible that the desiccant shifts its position in real time by measurement of weight or like of the desiccant.

The scope of the invention is not limited to the aforementioned embodiments, but various embodiments may be further proposed by simple change, addition and deletion of components of the present invention.

What is claimed is:

1. A humidity adjusting apparatus comprising:

a dehumidifier which absorbs moisture contained in air;

a dryer which emits moisture into the air so that the air becomes more humid;

a barrier wall partitioning the dehumidifier from the dryer;

first and second plate-shaped desiccants extending transverse to the barrier wall, the first plate-shaped desiccant having a first surface and the second plate-shaped desiccant having a second surface, the first and second surfaces facing each other;

racks provided on the first and second facing surfaces;

a pinion engaged with the racks; and a motor coupled to the pinion and configured to drive the first and second desiccants.

2. The humidity adjusting apparatus according to claim 1, wherein the first and second desiccants are provided one above the other in a vertically extending direction of the humidity adjusting apparatus.

3. The humidity adjusting apparatus according to claim 1, wherein the first and second desiccants have a rectangular shape.

4. The humidity adjusting apparatus according to claim 1, further comprising a heater mounted in the dryer.

5. The humidity adjusting apparatus according to claim 1, wherein the motor comprises a step motor.

6. The humidity adjusting apparatus according to claim 1, wherein at least one fan is installed at least at one of the dryer and dehumidifier.

7. The humidity adjusting apparatus according to claim 1, wherein the first and second desiccants have a same shape.

8. The humidity adjusting apparatus according to claim 1, wherein a positioning of the first and second desiccants is configured to shift at predetermined intervals with respect to at least one of the dryer and dehumidifier.

9. A humidity adjusting apparatus, comprising:

a barrier wall partitioning an inner space of the apparatus into a dehumidifier and a dryer;

a plurality of desiccants configured to move linearly and transverse to the barrier wall; and a motor configured to drive the plurality of desiccants.

10. The humidity adjusting apparatus according to claim 9, wherein at least two of the plurality of desiccants is provided one above the other in a vertically extending direction of the humidity adjusting apparatus.

11. The humidity adjusting apparatus according to claim 9, wherein the desiccants have a same shape.

12. The humidity adjusting apparatus according to claim 9, further comprising:

racks provided on oppositely facing surfaces of the desiccants; and a pinion positioned between the racks, the pinion configured to be driven by the motor.

13. The humidity adjusting apparatus according to claim 9, wherein a moving direction of the desiccants is orthogonal to a flow channel of air which passes through the desiccants.

14. The humidity adjusting apparatus according to claim 9, wherein the dryer has an air temperature higher than that of the dehumidifier.

15. The humidity adjusting apparatus according to claim 9, wherein the dryer comprises a heater configured to heat air introduced to the desiccants.

16. The humidity adjusting apparatus according to claim 9, wherein one desiccant is moved in a direction opposite to another desiccant at the same time.

17. A humidity adjusting apparatus, comprising:

a plurality of desiccants configured to move linearly between a dryer and a dehumidifier, the desiccants being configured to move together; and a motor configured to drive the desiccants.

18. The humidity adjusting apparatus according to claim 17, wherein the desiccants have a rectangular shape.

19. The humidity adjusting apparatus according to claim 17, further comprising:

racks provided on each desiccant; and a pinion engaging the racks and connected to the motor.

* * * * *